United States Patent [19]

Takakura et al.

[11] Patent Number: 5,052,348

[45] Date of Patent: Oct. 1, 1991

[54] COOLING SYSTEM FOR AN ENGINE

[75] Inventors: Yoshinari Takakura, Anjo; Mikio Nakashima, Okazaki; Hidekuni Hashizume, Toyota, all of Japan

[73] Assignee: Aisin Seiki Kabushiki Kaisha, Kariya, Japan

[21] Appl. No.: 609,776

[22] Filed: Nov. 7, 1990

[30] Foreign Application Priority Data

Nov. 7, 1989 [JP] Japan ..... 1-129809

[51] Int. Cl.[5] ..... F01P 3/02

[52] U.S. Cl. ..... 123/41.74; 123/41.55; 277/68; 277/235 B

[58] Field of Search ..... 123/41.55, 41.72, 41.74, 123/41.79, 41.44, 198 C; 277/32, 68, 235 B, 237 R

[56] References Cited

U.S. PATENT DOCUMENTS 1,972,814 9/1934 Anderson ..... 123/41.74

4,759,317 7/1988 Ampferer ..... 123/41.74

*Primary Examiner*—Noah P. Kamen

*Attorney, Agent, or Firm*—Oblon, Spivak, McClelland, Maier & Neustadt

[57] ABSTRACT

A cooling system for an engine includes a cylinder block defining a water jacket therein, the water jacket having an inlet. A water pump housing is fixed to the cylinder block and a water pump suction cover is fixed to the housing and sealed thereto by a gasket. Together, they form a cooling water inlet passage. An integral projecting portion of the gasket projects into the water jacket inlet to guide water into the water jacket in a preferential direction.

4 Claims, 2 Drawing Sheets

COOLING SYSTEM FOR AN ENGINE

BACKGROUND OF THE INVENTION

1. Field of the Invention

The present invention relates to a cooling system for an engine, and more particularly to a cooling system having means to control the flow of a cooling medium.

2. Description of the Related Art

In general, a cooling system for an engine is designed to provide the most suitable cooling condition for generating high power or producing good gas mileage.

For example, a favorable flow of a cooling water (cooling medium) is shown in FIG. 3. There, the cooling water flows from one side 72 of a cylinder block 71 to which is fixed an intake manifold (not shown), to the other side 73 of the cylinder block 71 to which is fixed an exhaust manifold (not shown). Thus, the intake manifold is colder than the exhaust manifold, so that intake air is cooled and the filling efficiency of the intake air into the cylinder is improved.

Referring to FIG. 4, a housing 81 of a conventional water pump (not shown) is sealed to a suction cover 82 of the water pump via a gasket 87. The suction cover 82 is sealed to a cylinder block 83 of an engine via a seal member 84. A cooling water passage 85 is formed between the housing 81 and the suction cover 82. A cooling water jacket 86 is formed in the cylinder block 83.

In the FIG. 4, an inlet 86*a* of the water jacket 86 is offset from a center 83*a* of the cylinder block 83 to achieve the above-mentioned most suitable cooling condition. However, cooling water will flow in two directions as shown by arrows X,Y. Additionally, the inlet is not offset in a conventional cylinder block, so that the above-mentioned cooling system cannot be applied to conventional cylinder block.

Therefore, the cooling arrangement is not suitable.

SUMMARY OF THE INVENTION

Accordingly, it is a primary object of the present invention to provide the most suitable cooling arrangement of a cooling system for an engine.

The above and other objects are achieved according to the present invention by a cooling system for an engine, including a cylinder block defining a water jacket therein, the water jacket having an inlet. Means are provided for forming a cooling water inlet passage connected to the water jacket inlet, the cooling water in the passage means include a sealing gasket. The sealing gasket includes an integral projecting portion projecting into the water jacket inlet to guide the water into the water jacket in a preferential direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
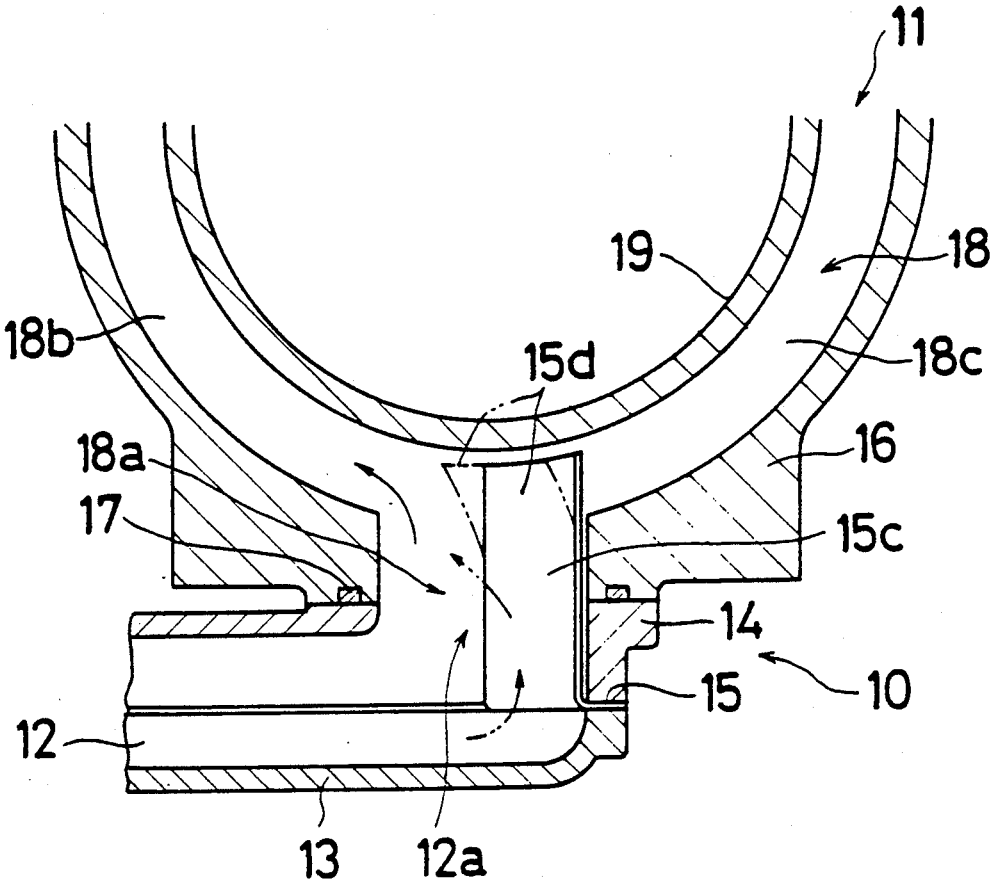
FIG. 1 is a cross-sectional view of a portion of a cooling system for an engine according to the invention.
Figure 2:
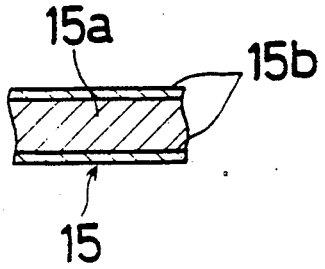
FIG. 2 is an enlarged partial cross-sectional view of a gasket of FIG. 1.

Referring first to FIGS. 1 and 2 wherein a cooling system 10 for an engine 11 is shown. A cooling water passage 12 is formed by a housing 13 of a water pump (not shown) and a suction cover 14 of the water pump. The housing 13 is bolted to the suction cover 14 and is sealed thereto via a metallic gasket 15. The suction cover 14 is bolted to a cylinder block 16 and is sealed thereto via a seal-ring 17.

In the cylinder block 16 each of the cylinders 19 is surrounded by a water jacket 18. An outlet 12*a* of the cooling water passage 12 is in fluid communication with an inlet 18*a* of the water jacket 18.

The gasket 15 is formed from a metallic member 15*a* and covering rubber members 15*b*, 15*b*. An integral projecting portion 15*c* of the gasket 15 projects into the outlet 12*a* and the water jacket 18, and guides the flow of cooling water (cooling medium) such that it flows in the preferential direction shown by arrows. The projecting portion 15*c* projects sufficiently into the water jacket that the water jacket 18 is divided into an upstream side 18*b* and a downstream side 18*c* by the projecting portion. An intake manifold (not shown) of the engine 11 is fixed to the upstream side 18*b* of the cylinder block 16, and an exhaust manifold (not shown) of the engine 11 is fixed to the downstream side 18*c* of the cylinder block 16.

Figure 3:
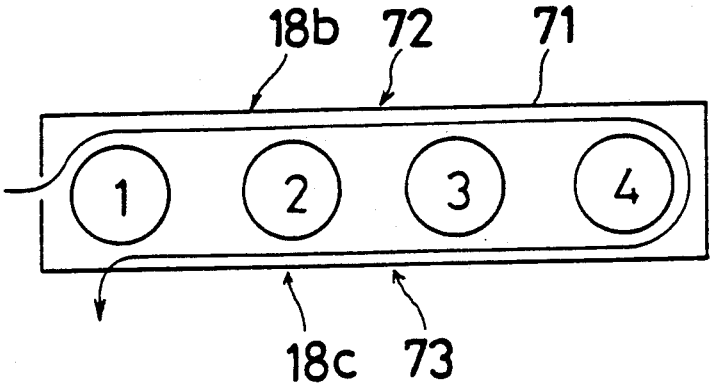
FIG. 3 is an explanatory view of a flow of cooling water in FIG. 1.
Figure 4:
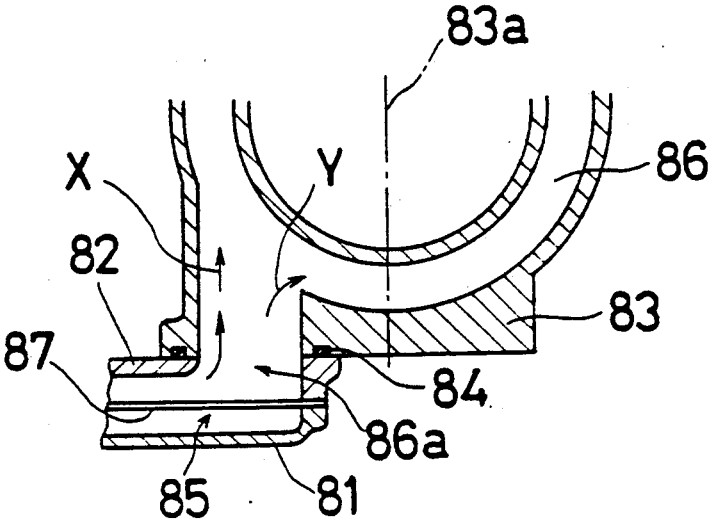
Fig. 4 (PRIOR ART)
FIG. 4 is a cross-sectional view of a conventional cooling system for an engine.

In the above-mentioned cooling system 10 for the engine 11, cooling water discharged from the water pump is guided by the projecting portion 15*c* of the gasket 15 and permitted to flow from the cooling water passage 12 to only the upstream side 18*b*. Cooling water flowed into the upstream side 18*b* flows to the downstream side 18*c* as shown in FIG. 3.

It is noted that, the bending of the projecting portion 15*c* as shown by the dotted line 15*d* in FIG. 1 produces a better effect.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cooling system for an engine, comprising:

a cylinder block defining a water jacket therein, said water jacket having an inlet;

means for forming a cooling water inlet passage connected to said water jacket inlet, said cooling water inlet passage means including a sealing gasket, wherein said sealing gasket includes an integral projecting portion projecting into said water jacket inlet and water jacket so as to guide water into one side of said water jacket.

2. The cooling system of claim 1, wherein said projecting portion projects sufficiently into said water jacket so as to divide said water jacket into an upstream side and a downstream side.

3. The cooling system of claim 2, wherein a distal end of said projecting portion is bent toward said upstream side.

4. The cooling system of claim 2, wherein said means for forming a cooling water inlet passage comprise a water pump housing fixed to said cylinder block and a water pump suction cover fixed to said housing and sealed thereto by said gasket.

* * * * *